US008903266B2

(12) United States Patent
Hamakawa

(10) Patent No.: US 8,903,266 B2
(45) Date of Patent: Dec. 2, 2014

(54) DEVELOPING DEVICE AND IMAGE FORMING APPARATUS

(71) Applicant: KYOCERA Document Solutions Inc., Osaka-shi (JP)

(72) Inventor: Hiroyuki Hamakawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 13/799,081

(22) Filed: Mar. 13, 2013

(65) Prior Publication Data

US 2013/0243474 A1 Sep. 19, 2013

(30) Foreign Application Priority Data

Mar. 16, 2012 (JP) ..... 2012-061113

(51) Int. Cl.
*G03G 15/09* (2006.01)
*G03G 15/095* (2006.01)

(52) U.S. Cl.
CPC ..... *G03G 15/0921* (2013.01); *G03G 15/0935* (2013.01); *G03G 15/095* (2013.01)
USPC ..... 399/103; 399/272; 399/277

(58) Field of Classification Search
USPC ..... 399/103, 105, 272, 282, 277
See application file for complete search history.

(56) References Cited

U.S. PATENT DOCUMENTS 5,913,094 A * 6/1999 Endo ..... 399/282 X
6,405,003 B2 * 6/2002 Uehara ..... 399/103
6,917,780 B2 * 7/2005 Ozawa et al. ..... 399/282
2008/0124137 A1 5/2008 Nakaue et al.
2008/0181675 A1 7/2008 Fujishima et al.

FOREIGN PATENT DOCUMENTS

JP 2002-082579 A 3/2002
JP 2004-170589 A 6/2004
JP 2005-326445 A 11/2005
JP 2008-185900 A 8/2008
JP 2008-003256 A 1/2010
JP 2010-122553 A 6/2010

OTHER PUBLICATIONS

Notice of Reasons for Rejection issued to corresponding JP Application No. 2012-061113 mailed Jun. 3, 2014.

* cited by examiner

*Primary Examiner* — Sophia S Chen
(74) *Attorney, Agent, or Firm* — Knobbe Martens Olson & Bear LLP

(57) ABSTRACT

A longitudinal end portion of an opposing magnetic member of a developer supporting rotator is positioned more longitudinally outside than a longitudinal end portion of a toner supporting side magnetic member. With respect to the opposing magnetic member facing the toner supporting side magnetic member and a downstream magnetic member disposed more downstream than the opposing magnetic member in a rotational direction, a magnetic force generated in a vicinity of both longitudinally end portions thereof is greater than a magnetic force generated longitudinally inside thereof. A housing includes a sealing portion that projects from a position facing a face at a longitudinal end portion of the developer supporting rotator toward the face, such that the sealing portion prevents the toner in a space between the face and an inner face of the housing from scattering outside.

4 Claims, 8 Drawing Sheets

DEVELOPING DEVICE AND IMAGE FORMING APPARATUS

INCORPORATION BY REFERENCE

This application is based on and claims the benefit of priority from Japanese Patent Application No. 2012-061113, filed on Mar. 16, 2012, the content of which is incorporated herein by reference.

BACKGROUND

The present disclosure relates to a developing device for developing an electrostatic latent image formed electro photographically and an image forming apparatus provided with the developing device.

In recent years, a developing device employing a touch-down type (also referred to as a hybrid type) has been well known. In this type, a two-component developer including at least a carrier and a toner is supported on a surface of a developer supporting rotator, such that a magnetic brush is formed by the carrier. The toner supplied from the magnetic brush to a toner supporting rotator forms a toner layer on a surface of the toner supporting rotator, such that the toner flies from the toner layer to an image carrier. An electrostatic latent image on a surface of the image carrier is developed into a toner image.

In the developing device of touch-down type, the toner in the toner layer formed on the surface of the toner supporting rotator may remain on the surface of the toner supporting rotator without being used for developing. In such a case, degraded residual toner may cause reduction in density of an image, and long-neglected undeveloped toner may cause degraded image quality and developing defect such as developing ghost.

In order to suppress generation of the above-mentioned developing defect, it is important to collect (strip) the undeveloped toner remaining on the surface of the toner supporting rotator toward the developer supporting rotator between development operations performed in series. As a method for stripping the undeveloped toner, a developing device has been known, in which magnetic members are arranged to be opposite to each other in polarity between the toner supporting rotator and the developer supporting rotator. In this configuration, magnetic members in the developer supporting rotator are supported such that a peak of a magnetic force is positioned more upstream in a rotational direction of the toner supporting rotator than a line connecting rotational centers of the toner supporting rotator and the developer supporting rotator.

In the abovementioned developing device, a magnetic brush is formed between the toner supporting rotator and the developer supporting rotator, while the magnetic brush inclines downstream in a rotational direction of the developer supporting rotator. In this manner, a force of constraint by the magnetic brush can maintain stripping of toner while preventing the developer from accumulating between the two rotators and from escaping from the magnetic force of constraint.

In this connection, it is necessary that the length of the magnetic brush formed on the surface of the developer supporting rotator is substantially the same as the length of the toner supporting rotator in a direction of a rotational axis (longitudinal direction), in order to securely strip all the toner remaining on the surface of the toner supporting rotator. If the length of the magnetic brush is too much greater than the length of the toner supporting rotator, it is likely that the carrier scatters upward inside the housing from end portions of the magnetic brush in the longitudinal direction and a bias voltage applied between the toner supporting rotator and the developer supporting rotator leaks to a flange portion of the toner supporting rotator, which is composed of an electrically conductive material for application of bias.

On the contrary, if the length of the magnetic brush is too much smaller than the length of the toner supporting rotator, it is likely that stripping of the residual toner by the magnetic brush is insufficient and the toner remaining on the surface of the toner supporting rotator scatters about and generates smudges in an end portion of an image.

In addition, when the length of the magnetic brush is too much smaller than the length of the toner supporting rotator, it is likely that gaps occur at both longitudinal end portions of the toner supporting rotator and the toner and carrier agitated by an agitation roller inside the developing device scatter through the gaps.

SUMMARY

In an aspect of the present disclosure, a developing device includes a housing, a developer supporting rotator, a toner supporting rotator and a voltage application unit.

The developer supporting rotator is disposed inside the housing. The developer supporting rotator includes a first rotating sleeve configured to support a two-component developer including at least a carrier and toner, the first rotating sleeve forming a face on which a magnetic brush is formed by the carrier included in the two-component developer. The developer supporting rotator includes the first rotating sleeve extending in a longitudinal direction to form a face, and a plurality of developer supporting side magnetic members that is disposed inside the first rotating sleeve and extends in the longitudinal direction.

The toner supporting rotator disposed inside the housing. The toner supporting rotator includes a second rotating sleeve arranged opposite to the developer supporting rotator and extending in the longitudinal direction to form a face, on which a toner supplied from the developer supporting rotator is supported to form a toner layer through the magnetic brush. The toner supporting rotator includes a toner supporting side magnetic member that is disposed inside the second rotating sleeve and extends in the longitudinal direction.

The voltage application unit is configured to apply a developing bias voltage between the toner supporting rotator and an image carrier, such that the toner supported by the toner supporting rotator flies to an electrostatic latent image on a surface of the image carrier to cause the electrostatic latent image to be developed into a toner image.

A longitudinal end portion of each of the plurality of developer supporting side magnetic members is longitudinally positioned more outside than a longitudinal end portion of the toner supporting side magnetic member. A magnetic force generated in a vicinity of both longitudinal end portions is greater than a magnetic force generated at a longitudinal inner portion, with respect to an opposing magnetic member facing the toner supporting side magnetic member and a downstream magnetic member disposed more downstream in a rotational direction than the opposing magnetic member, among the plurality of developer supporting side magnetic members.

The housing includes a sealing portion that projects from a position of the housing facing a longitudinal end face of the developer supporting rotator toward the longitudinal end face, such that the toner in a space between the longitudinal end face and an inner face of the housing is prevented from scattering outside the space.

In another aspect of the present disclosure, an image forming apparatus includes the abovementioned developing device and an image carrier, a transfer unit, and a fusing unit. An electrostatic latent image is formed on a surface of the image carrier and a toner image is formed on the electrostatic latent image by the toner supplied from the toner layer of the developing device. The transfer unit is configured to directly or indirectly transfer the toner image formed on the image carrier to a sheet-like recording medium. The fusing unit is configured to fuse the toner image transferred to the sheet-like recording medium.

DETAILED DESCRIPTION

Embodiments of the present disclosure will be described hereinafter with reference to the drawings.

Figure 1:
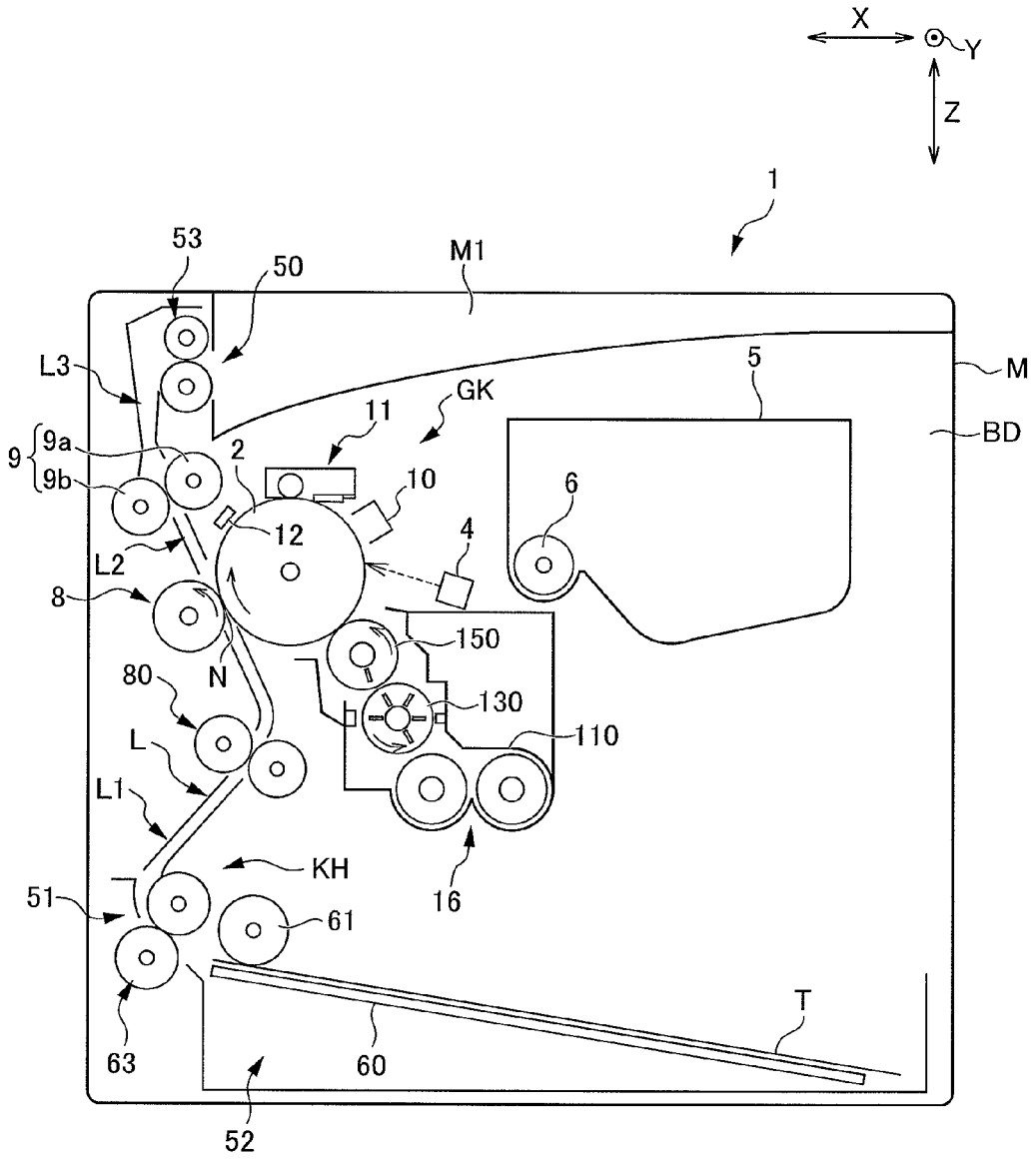
FIG. 1 is a diagram illustrating an arrangement of components of a printer 1 according to an embodiment of the present disclosure.

An overall setup of a printer 1 will be described as an example of an image forming apparatus according to an embodiment of the present disclosure, with reference to FIG. 1. FIG. 1 is a diagram illustrating an arrangement of components of the printer 1 according to the embodiment of the present disclosure.

Hereinafter, when viewed by a user standing in front of the printer 1, it will be represented that a left-right direction is a direction X, forward-backward direction (depth direction) is a direction Y, and a vertical direction is a direction Z.

As shown in FIG. 1, the printer 1 as an image forming apparatus includes an apparatus main body M, an image forming portion GK, and a paper feeding/discharging unit KH. The image forming portion GK forms a toner image on a sheet of paper T, as a sheet-shaped recording medium, based on predetermined image information. The paper feeding/discharging unit KH feeds a sheet of paper T to the image forming portion GK and discharges the sheet of paper T on which the toner image is formed. The external shape of the apparatus main body M is composed of a case BD as a housing.

As shown in FIG. 1, the image-forming unit GK includes a photosensitive drum 2 as an image carrier (photosensitive body), a charging unit 10, a laser scanner unit 4 as an exposure unit, a developing unit 16, a toner cartridge 5, a toner supply unit 6, a cleaning device 11, a neutralization unit 12, a transfer roller 8, and a fusing unit 9.

As shown in FIG. 1, the paper feeding/discharging portion KH includes a paper feed cassette 52, a conveyance path L for a sheet of paper T, a pair of registration rollers 80, and a paper discharging unit 50.

Components of the image forming portion GK and the paper feeding/discharging portion KH will be described in detail hereinafter.

First, a description is provided for the image forming portion GK.

Charging by the charging unit 10, exposure by the laser scanner unit 4, development by the developing device 16, transfer by the transfer roller 8, neutralization by the neutralization unit 12, and cleaning by the cleaning device 11 are sequentially performed in order, from upstream to downstream along a surface of the photosensitive drum 2 in the image-forming unit GK.

The photosensitive drum 2 has a cylindrical shape, and functions as a photosensitive body or an image carrier. The photosensitive drum 2 is disposed to be rotatable in a direction indicated by an arrow about a first rotational shaft J1 (see FIG. 2) extending in a direction orthogonal to a direction in which a sheet of paper T is conveyed through the conveyance path L. An electrostatic latent image is formed on the surface of the photosensitive drum 2.

The charging unit 10 is arranged opposite to the surface of the photosensitive drum 2. The charging unit 10 negatively or positively charges the surface of the photosensitive drum 2 uniformly (with negative or positive polarity).

The laser scanner unit 4 functions as an exposure unit, and is disposed to be spaced apart from the surface of the photosensitive drum 2. The laser scanner unit 4 includes a laser light source, a polygon mirror, a polygon mirror driving motor and the like, which are not illustrated.

The laser scanner unit 4 scans and exposes the surface of the photosensitive drum 2 based on image information that is entered from an external device such as a PC (personal computer). When the surface of the photosensitive drum 2 is scanned and exposed by the laser scanner unit 4, an electric charge is removed from an exposed portion on the surface of the photosensitive drum 2. In this manner, an electrostatic latent image is formed on the surface of the photosensitive drum 2.

The developing device 16 is provided corresponding to the photosensitive drum 2, and is arranged opposite to the surface of the photosensitive drum 2. The developing device 16 causes single color toner (black toner in general) to adhere to an electrostatic latent image formed on the photosensitive drum 2, thereby forming a single color toner image on the surface of the photosensitive drum 2. The developing device 16 includes a housing 110, a developing roller 150 as a toner supporting rotator arranged opposite to the surface of the photosensitive drum 2, a magnetic roller 130 as the developer supporting rotator, agitation rollers 120*a*, 120*b* for agitating the toner, and the like. Details of the developing device 16 will be described later.

The toner cartridge 5 is provided corresponding to the developing device 16, and stores toner to be supplied to the developing device 16.

The toner supply unit 6 is provided corresponding to the toner cartridge 5 and the developing device 16, and supplies toner stored in the toner cartridge 5 to the developing device 16. The toner supply unit 6 and the inside of the housing 110 of the developing device 16 are connected with each other via a toner feed passage that is not illustrated in the drawings.

The transfer roller 8 transfers a toner image, which has been developed on the surface of the photosensitive drum 2, to a sheet of paper T. A transfer bias application unit (not shown) applies a transfer bias to the transfer roller 8 for transferring a toner image formed on the photosensitive drum 2 to the sheet of paper T. The transfer roller 8 is configured to be rotatable in a state of abutting the photosensitive drum 2.

The sheet of paper T conveyed through the conveyance path L is interposed between the photosensitive drum 2 and the transfer roller 8. The interposed sheet of paper T is pressed against the surface of the photosensitive drum 2. A transfer nip N is formed between the photosensitive drum 2 and the transfer roller 8. At the transfer nip N, a toner image developed on the photosensitive drum 2 is transferred to the sheet of paper T.

The neutralization unit 12 is arranged opposite to the surface of the photosensitive drum 2. By illuminating light on the surface of the photosensitive drum 2, the neutralization unit 12 discharges electricity (neutralizes electrical charge) on the surface of the photosensitive drum 2, to which the transfer has been performed.

The cleaning device 11 is arranged opposite to the surface of the photosensitive drum 2. The cleaning device 11 removes toner remaining and matter attached to the surface of the photosensitive drum 2 and conveys the removed to a collection mechanism. The toner and attached matter thus conveyed is collected by the collection mechanism.

A fusing unit 9 melts and applies a pressure to the toner that forms a toner image transferred to the sheet of paper T, and fixes the toner on the sheet of paper T. The fusing unit 9 includes a heating rotator 9*a* that is heated by a heater, and a pressing rotator 9*b* that is in pressure-contact with the heating rotator 9*a*. The heating rotor 9*a* and the pressing rotor 9*b* interpose to apply a pressure to the sheet of paper T on which the toner image is transferred, and convey the sheet of paper T. The sheet of paper T is conveyed while it is interposed between the heating rotator 9*a* and the pressing rotator 9*b*. As a result, the toner transferred to the sheet of paper T is fused, pressed and fixed to the sheet of paper T.

Next, the paper feeding/discharging portion KH is described.

As shown in FIG. 1, a paper cassette 52 for storing sheets of paper T is disposed in a lower portion of the apparatus main body M. The paper feeding cassette 52 is configured to be horizontally withdrawable from a left side (left side in FIG. 1) of the apparatus main body M. The paper feeding cassette 52 includes a paper tray 60 on which the sheets of paper T are placed. The paper feeding cassette 52 accommodates the sheets of paper T stacked on the paper tray 60. The sheets of paper T placed on the paper tray 60 are fed to the paper feed path L by a cassette feeding part 51 disposed in an end part of the paper feeding cassette 52 on a side of paper feeding (in a left end part of FIG. 1). The cassette feeding part 51 includes a double feed prevention mechanism including a forward feed roller 61 for picking up a sheet of paper T on the paper tray 60 and a pair of paper feeding rollers 63 for feeding the sheet of paper T sheet by sheet to the paper feed path L.

A paper discharging unit 50 is provided at an upper portion of the apparatus main body M. The paper discharging unit 50 discharges a sheet of paper T outside the apparatus main body M by a pair of third rollers 53. Details of the paper discharging unit 50 will be described later.

The conveyance path L for conveying a sheet of paper T includes a first conveyance path L1 from the cassette paper feed unit 51 to the transfer nip N, a second conveyance path L2 from the transfer nip N to the fusing unit 9, and a third conveyance path L3 from the fusing unit 9 to the paper discharging unit 50.

In addition, a sensor for detecting a sheet of paper T and a pair of registration rollers 80 for correcting skew of the sheet of paper T and adjusting timing between formation of a toner image in the image forming unit GK and feeding of the sheet of paper T, are disposed midway in the first paper path L1 (more specifically, between the pair of paper feeding rollers 63 and the transfer roller 8). The sensor is disposed immediately before the pair of registration rollers 80 in the conveyance direction of a sheet of paper T (upstream in the conveyance direction). The pair of registration rollers 80 performs the aforementioned correction and timing adjustment for a sheet of paper T based on the information of a detected signal from the sensor and conveys the sheet of paper T.

The paper discharging unit 50 is formed in an end part of the third paper feed path L3. The paper discharging unit 50 is disposed in an upper portion of the apparatus main body M. The paper discharging unit 50 has an aperture opening in a right direction with respect to the apparatus main body M (right side in FIG. 1). The paper discharging unit 50 discharges a sheet of paper T, which is conveyed in the third conveyance path L3, outside the apparatus main body M by way of the pair of third rollers 53.

A discharged paper collection part M1 is formed in a vicinity of the aperture of the paper discharging unit 50. The discharged paper collection part M1 is formed on an upper face (outer face) of the apparatus main body M. The discharged paper collection part M1 is a portion of the upper face of the device main body M formed to be depressed downward. A bottom face of the discharged paper collection part M1 constitutes a part of the upper face of the apparatus main body M. Sheets of paper T, on which predetermined toner images are formed, are discharged from the paper discharging unit 50, and collected to be stacked at the discharged paper collection part M1.

A sensor for detecting a sheet of paper is disposed at a predetermined position of each paper path.

Next, a detailed setup of the developing device 16, which is a characterizing part of the printer 1 according to the present embodiment, is described with reference to FIGS. 2 to 7.

Figure 2:
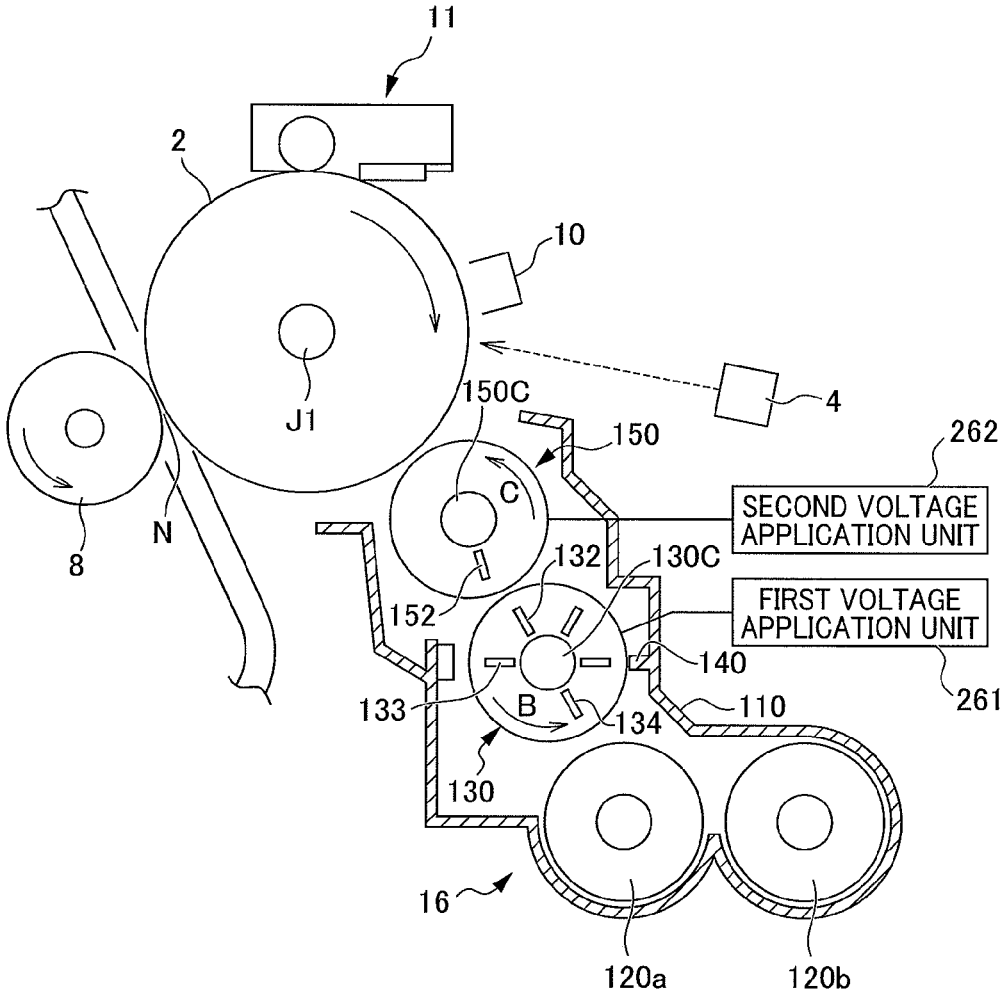
FIG. 2 is a cross-sectional view illustrating a developing device 16 and a photosensitive drum 2 in the printer 1 according to the present embodiment.
Figure 3:
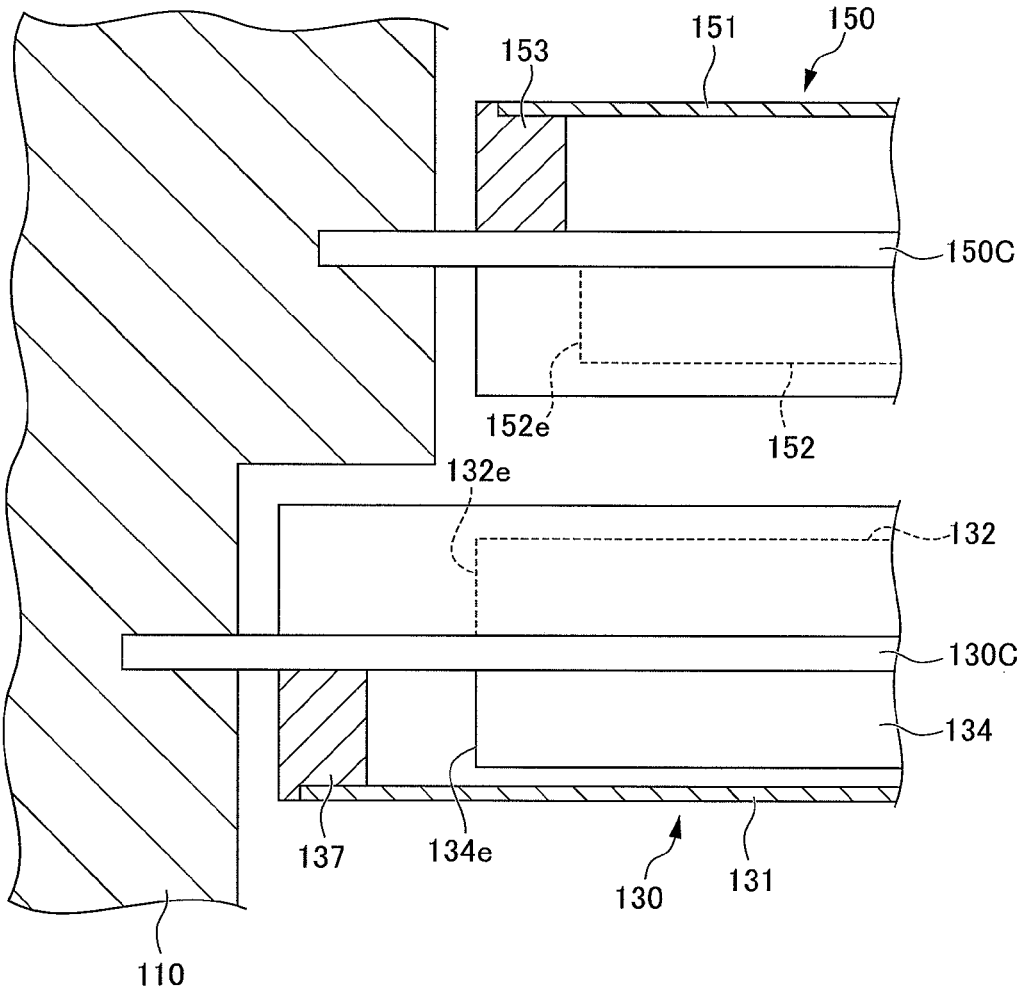
FIG. 3 is an enlarged half sectional view illustrating a vicinity of longitudinal end portions of a magnetic roller 130 and a developing roller 150.
Figure 4:
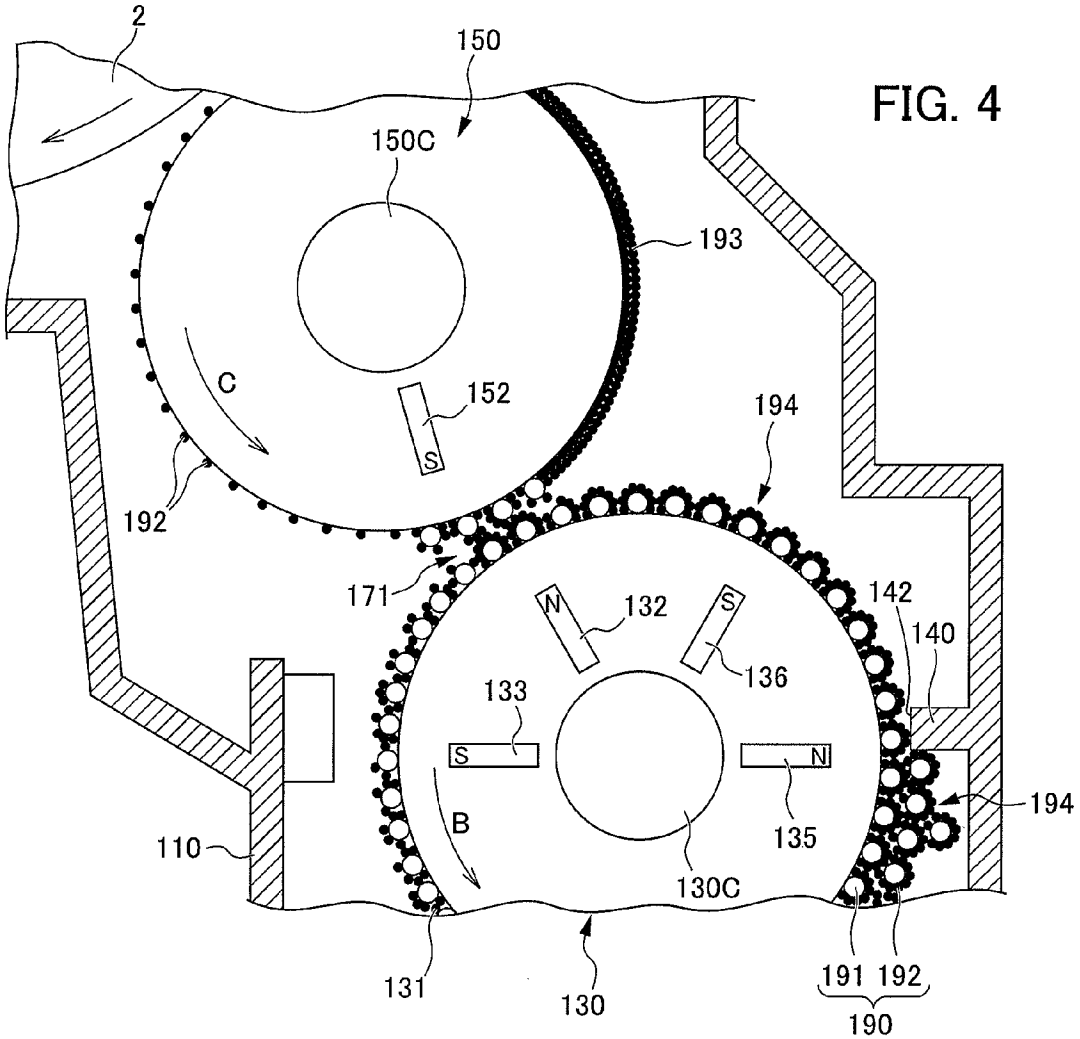
FIG. 4 is a partially enlarged view illustrating a toner 192 being conveyed in a vicinity in which the magnetic roller 130 and the developing roller 150 are opposite to each other, and substantially all of the toner 192 being stripped from a surface of the developing roller 150.
Figure 5:
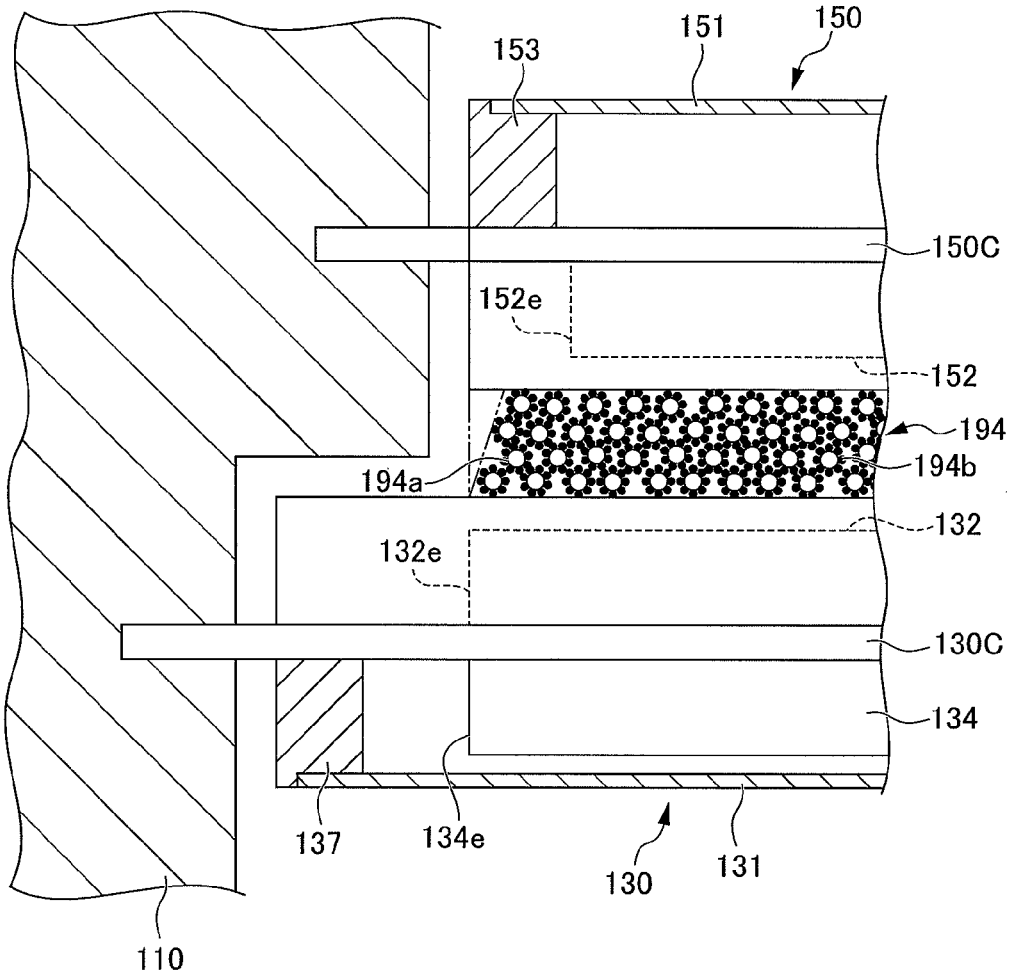
FIG. 5 is a partially enlarged cross-sectional view illustrating a magnetic brush 194 being formed between the developing roller 150 and the magnetic roller 130.
Figure 6:
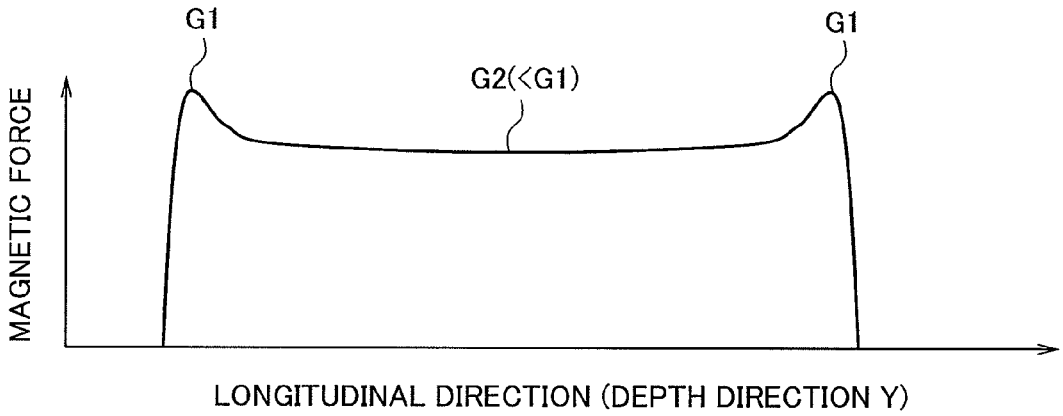
FIG. 6 is a diagram illustrating a longitudinal distribution of magnetic force of magnetic members 132, 133 disposed at the magnetic roller 130.
Figure 7:
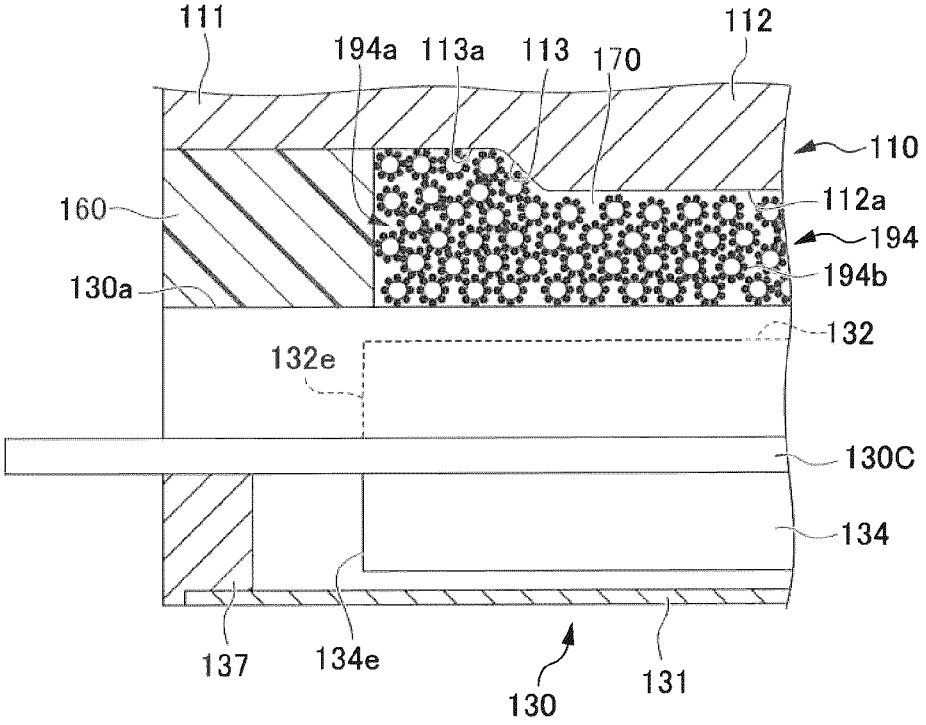
FIG. 7 is a partially enlarged cross-sectional view illustrating a configuration of a sealing member 160 formed between the magnetic roller 130 and a first housing portion 111 of a housing 110 facing a longitudinal end portion of the magnetic roller 130.

FIG. 2 is a cross-sectional view illustrating the developing device 16 and the photosensitive drum 2 in the printer 1 according to the present embodiment. FIG. 3 is an enlarged half sectional view illustrating a vicinity of longitudinal end portions of the magnetic roller 130 and the developing roller 150. FIG. 4 is a partially enlarged view illustrating a toner 192 being conveyed in a vicinity in which the magnetic roller 130 and the developing roller 150 are opposite to each other, and substantially all of the toner 192 being stripped from a surface of the developing roller 150. FIG. 5 is a partially enlarged cross-sectional view illustrating a magnetic brush 194 being formed between the developing roller 150 and the magnetic roller 130. FIG. 6 is a diagram illustrating a longitudinal distribution of magnetic force of magnetic members 132, 133 disposed at the magnetic roller 130. FIG. 7 is a partially enlarged cross-sectional view illustrating a configuration of a sealing member 160 formed between the magnetic roller 130 and a first housing portion 111 of a housing 110 facing a longitudinal end portion of the magnetic roller 130.

As shown in FIG. 2, the developing device 16 of the present embodiment includes the housing 110, the agitation rollers 120*a*, 120*b*, the magnetic roller 130, a layer thickness regulation member 140, the developing roller 150, a first voltage application unit 261, and a second voltage application unit 262. The housing 110 is a container of developer that accommodates a two-component developer including at least a magnetic carrier and toner. The agitation rollers 120*a*, 120*b* are disposed in a bottom portion of the housing 110. The magnetic roller 130 is disposed above the agitation roller 120*a* in a vertical direction and functions as a developer supporting rotator. The layer thickness regulation member 140 is disposed close to the magnetic roller 130. The developing roller 150 is arranged opposite to the magnetic roller 130 and functions as a toner supporting rotator. The first voltage application unit 261 and the second voltage application unit 262 function as a voltage application unit that applies developing bias voltage between the developing roller 150 and the magnetic roller 130.

The toner 192 is supplied from the toner cartridge 5 (see FIG. 1) to the housing 110 via the toner supply unit 6 (see FIG. 1).

The agitation rollers 120*a*, 120*b* agitate the two-component developer 190 accommodated in the housing 110. Static electricity occurs due to friction in the agitated two-component developer 190. In the present embodiment, for example, the magnetic carrier (carrier) 191 is negatively charged and the toner 192 is positively charged. The toner 192 adheres to the magnetic carrier 191 due to an electrostatic force.

As shown in FIGS. 2 to 4, the magnetic roller 130 includes a first rotating sleeve 131, a flange 137, and a plurality of developer supporting side magnetic members 132 to 136.

The first rotating sleeve 131 is composed of a non-magnetic material and has a cylindrical shape. The first rotating sleeve 131 is rotatable about a fixed shaft 130C in a predetermined direction, and extends in the longitudinal direction (direction of the fixed shaft 130C). The first rotating sleeve 131 is rotationally driven in a direction of an arrow B shown in FIGS. 2 and 4.

The flange 137 is composed of an electrically conductive material. The flange 137 closes both longitudinal end portions of the first rotating sleeve 131. The first voltage application unit 261 applies first bias voltage, in which a direct current and an alternating current are superposed, to the flange 137.

As shown in FIG. 4, the plurality of developer supporting side magnetic members 132 to 136 extends longitudinally inside the first rotating sleeve 131, and is aligned and fixed at predetermined intervals in a rotational direction of the magnetic roller 130. The developer supporting side magnetic members 132 to 136 are composed of magnets.

Among the plurality of developer supporting side magnetic members 132 to 136, an opposing magnetic member 132 is fixed at a position in the magnetic roller 130, such that the opposing magnetic member 132 is configured to be close to the developing roller 150. The opposing magnetic member 132 is arranged such that an N pole (opposing pole) is directed outward (toward a circumferential surface of the first rotating sleeve 131).

Other developer supporting side magnetic members 133 to 136 are fixed at predetermined intervals in a circumferential direction of the first rotating sleeve 131 with respect to the opposing magnetic member 132, inside the first rotating sleeve 131. The developer supporting side magnetic members 133, 134 and 136 are each arranged such that an S pole (separation pole) is directed outward (toward the circumferential surface of the first rotating sleeve 131). The developer supporting side magnetic member 135 is arranged such that an N pole is directed outward (toward the circumferential surface of the first rotating sleeve 131).

As shown in FIG. 4, the magnetic force exerted by the developer supporting side magnetic members 132 to 136 causes a part of the two-component developer 190 accommodated in the housing 110 to be retained on the surface of the first rotating sleeve 131. In addition, the two-component developer 190 retained on the surface of the first rotating sleeve 131 forms a developer layer (magnetic brush 194).

The layer thickness regulation member 140 is positioned in a vicinity of a horizontal surface passing through a center of the fixed shaft 130C, which is a rotational center of the magnetic roller 130. The layer thickness regulation member 140 is formed integrally with the housing 110 and projects toward the surface of the magnetic roller 130. A front end portion 142 of the layer thickness regulation member 140 is configured to be opposite to and close to the surface of the magnetic roller 130 in order to regulate the thickness of the developer layer 194 retained on the surface of the magnetic roller 130, such that the thickness of the developer layer 194 is maintained constant after passing through the layer thickness regulation member 140.

The developing roller 150 is arranged opposite to the magnetic roller 130. The developing roller 150 retains the toner 192 supplied from the magnetic roller 130 on the surface thereof. A toner layer 193 is formed on the surface of the developing roller 150. More specifically, the toner 192 migrates from the magnetic brush 194 to the surface of the developing roller 150, thereby forming the toner layer 193. The developing roller 150 includes a second rotating sleeve 151 composing a surface thereof, a flange 153, and a toner supporting side magnetic member 152.

The second rotating sleeve 151 is composed of a non-magnetic material and has a cylindrical shape. The second rotating sleeve 151 is rotatable about a fixed shaft 150C in a predetermined direction, and extends in the longitudinal direction (direction of the fixed shaft 150C). At a position facing the first rotating sleeve 131, the second rotating sleeve 151 is rotationally driven in a direction of an arrow C shown in FIGS. 2 and 4.

The flange 153 is composed of an electrically conductive material and closes both longitudinal end portions of the second rotating sleeve 151. The second voltage application unit 262 applies second bias voltage, in which a direct current and an alternating current are superposed, to the flange 153.

The toner supporting side magnetic member 152 extends longitudinally and is fixed opposite to the opposing magnetic member 132 inside the second rotating sleeve 151. The toner supporting side magnetic member 152 is composed of a magnet. The toner supporting side magnetic member 152 is arranged at a predetermined interval with respect to the opposing magnetic member 132 across a region in which the magnetic roller 130 and the developing roller 150 are close to each other. In other words, the toner supporting side magnetic member 152 and the opposing magnetic member 132 are arranged opposite to each other across the region in which the second rotating sleeve 151 and the first rotating sleeve 131 are close to each other.

An end portion of the toner supporting side magnetic member 152 facing the opposing magnetic member 132 has an opposite polarity to that of an outer side of the opposing magnetic member 132. In other words, the toner supporting side magnetic member 152 is arranged such that an S pole is directed outward (toward a circumferential surface of the second rotating sleeve 151).

As a result, a first magnetic field 171 is generated between the opposing magnetic member 132 disposed inside the magnetic roller 130 and the toner supporting side magnetic member 152 disposed inside the developing roller 150. In a region in which the magnetic field 171 is generated between the magnetic roller 130 and the developing roller 150, the developer layer 194 rises from the surface of the magnetic roller 130 under the influence of the first magnetic field 171. Accordingly, the magnetic brush 194 is formed to come into contact with the developing roller 150.

As shown in FIG. 3, longitudinal end portions 132*e* to 136*e* of the developer supporting side magnetic members 132 to 136 of the magnetic roller 130 are positioned more longitudinally outward than a longitudinal end portion 152*e* of the toner supporting side magnetic member 152 of the developing roller 150. The end portions 132*e* to 136*e* are each positioned more outward than the end portion 152*e* by 2.0 to 3.5 mm. Positions (in the longitudinal direction) of the end portions 132*e* to 136*e* with respect to the end portion 152*e* are the same.

With respect to the opposing magnetic member 132 facing the toner supporting side magnetic member 152 of the developing roller 150 and a downstream magnetic member 133 positioned more downstream of the opposing magnetic member 132 among the developer supporting side magnetic members 132 to 136 of the magnetic roller 130, a magnetic distribution is configured as shown in FIG. 6. More specifically, a magnetic force G1 generated in a vicinity of both longitudinal ends of the opposing magnetic member 132 and the downstream magnetic member 133 is greater than a magnetic force G2 generated on the longitudinally inner side of the opposing magnetic member 132 and the downstream magnetic member 133.

The magnetic force G1 is greater than the magnetic force G2 by, for example, 7 to 15 mT.

With the magnetic force distribution described above, portions 194*a* of the magnetic brush 194 at both longitudinal ends of the magnetic roller 130 reach vicinities of both end edges of the second rotating sleeves 151 of the developing roller 150 as shown in FIG. 5, among the magnetic brush 194 formed on the surface of the first rotating sleeve 131 of the magnetic roller 130. In addition, the tip of the magnetic brush 194 comes to rub the substantially entire surface of the developing roller 150 in the longitudinal direction. In this manner, the longitudinal length of the developing roller 150 and the longitudinal length of the magnetic brush 194 are substantially the same.

When the toner 192 is stripped from the developing roller 150 toward the magnetic roller 130, a rubbing effect of the magnetic brush 194 allows more infallible stripping of the undeveloped toner 192 remaining on the substantially entire area of the surface of the developing roller 150.

Figure 8:
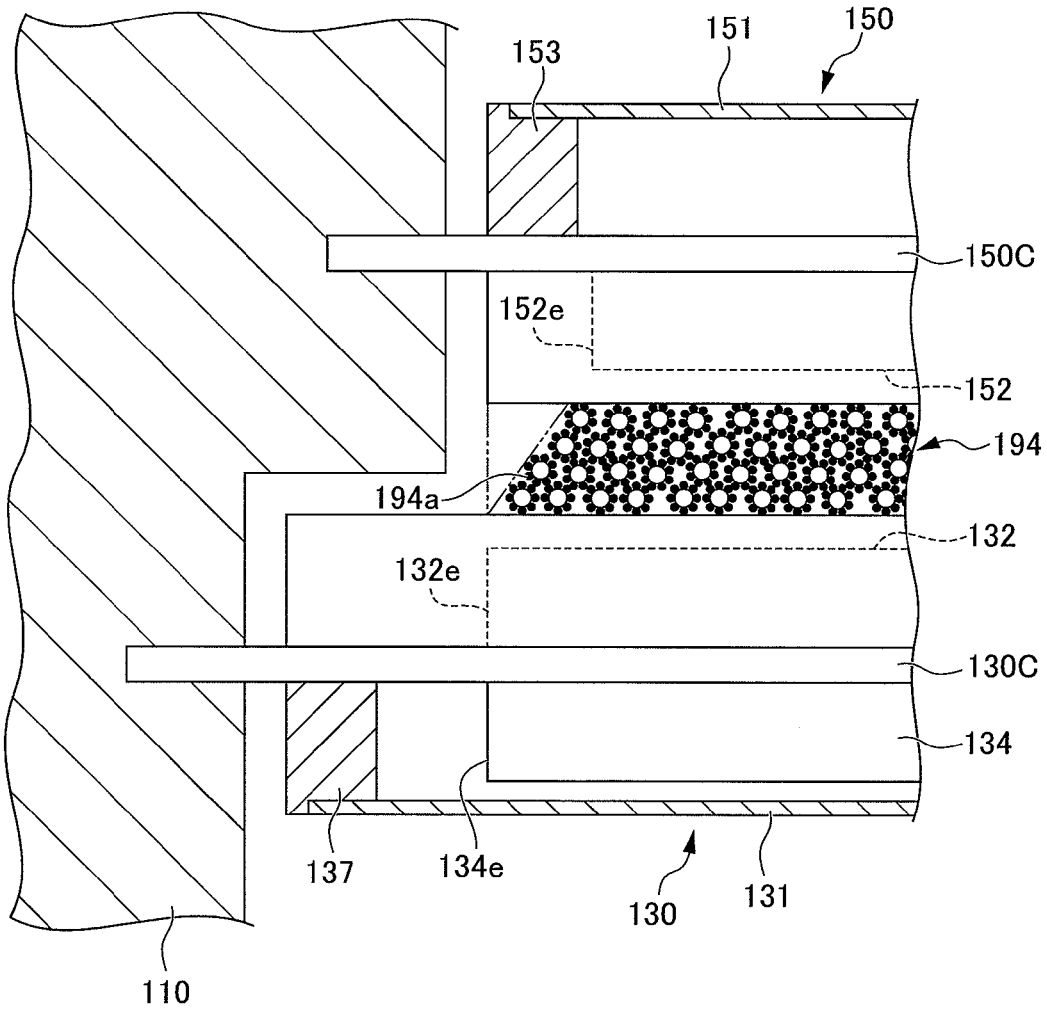
FIG. 8 is a partially enlarged cross-sectional view illustrating forming of a magnetic brush for a conventional case in which a magnetic distribution of the magnetic members 132 to 136 of the magnetic roller 130 is set longitudinally uniform.

It should be noted that a magnetic distribution has been conventionally configured such that the magnetic force G1 generated in the vicinity of both longitudinal ends of the opposing magnetic member 132 and the downstream magnetic member 133 is the same or substantially the same as the magnetic force G2, which is generated on the longitudinally inner side of the opposing magnetic member 132 and the downstream magnetic member 133. As shown in FIG. 8, tips of the portions 194*a* of the magnetic brush 194 at the both longitudinal ends of the magnetic roller 130 are positioned inside the both longitudinal end edges of the second rotating sleeve 151 of the developing roller 150, among the magnetic brush 194 formed on the surface of the first rotating sleeve 131 of the magnetic roller 130. In other words, the tip of the magnetic brush 194 is in a state of rubbing neither of the longitudinal ends of the developing roller 150.

Accordingly, when the toner 192 is stripped from the developing roller 150 toward the magnetic roller 130 by a rubbing effect of the magnetic brush 194, it has been hardly possible to strip the undeveloped toner 192 remaining on the both longitudinal end portions of the surface of the developing roller 150.

In addition, as shown in FIG. 7, a concave portion 113 is formed at a first housing portion 111 of the housing 110 facing a longitudinal end portion of the magnetic roller 130. The concave portion 113 is configured to more recede in a direction away from the surface of the magnetic roller 130 than an inner face 112*a* of the second housing portion 112, which lies more longitudinally inside than the first housing portion 111.

The concave portion 113 recedes more than the inner face 112*a* of the second housing portion 112 by, for example, 2 to 4 mm.

A sealing member 160 as a sealing portion is provided at an inner face 113*a* of the concave portion 113, which faces the longitudinal end portion of the first rotating sleeve 131 and a surface 130*a* of the flange 137. The sealing member 160 projects toward the first rotating sleeve 131 positioned at the longitudinal end portion of the magnetic roller 130 and the surface 130*a* of the flange 137.

The sealing member 160 prevents the toner 192 in a space 170 from scattering outside, which is encompassed by the first rotating sleeve 131 positioned longitudinally at the end portion of the magnetic roller 130, the surface 130*a* of the flange 137, and an inner face of the housing 110 (including the first housing portion 111 and the second housing portion 112).

The sealing member 160 is provided in a range from the vicinity of the opposing magnetic member 132 of the magnetic roller 130 to the downstream magnetic member 133 positioned more downstream in the rotational direction than the opposing magnetic member 132. The sealing member 160 is composed of a flexible elastic member in order not to exert a load on rotation of the magnetic roller 130, for example, a fibrous material, and a sponge-like material.

Next, operation of the developing device 16 according to the present embodiment is described hereinafter with reference to FIGS. 2 to 7.

When the developing device 16 according to the present embodiment performs normal development, a second bias voltage is applied via the second voltage application unit 262. Under the condition described above, the two-component developer 190 supplied from the toner cartridge 5 (see FIG. 1) is first agitated by the agitation roller 120*a*, 120*b* and circulates inside the housing 110. As a result, the agitated two-component developer 190 generates static electricity due to friction, which negatively charges the magnetic carrier 191 and positively charges the toner 192. With an electrostatic force, the toner 192 adheres to the magnetic carrier 191.

The two-component developer 190 thus charged inside the housing 110 is retained on the surface of the magnetic roller 130 rotating in a rotational direction B due to a magnetic force applied by the developer supporting side magnetic members 132 to 136 provided inside the first rotating sleeve 131. In addition, a developer layer (magnetic brush) 194 is formed on the surface of the magnetic roller 130 by the magnetic force applied by the plurality of developer supporting side magnetic members 134, 135. The developer layer 194 formed on the surface of the magnetic roller 130 rotationally moves to come into contact with the layer thickness regulating member 140, following rotation of the first rotating sleeve 131.

Accordingly, the developer layer 194 is controlled to have a predetermined layer thickness.

The developer layer 194 controlled to have the predetermined layer thickness by the layer thickness regulating member 140 rotationally moves to a vicinity where the opposing magnetic member 132 of the magnetic roller 130 and the toner supporting side magnetic member 152 of the developing roller 150 face each other, following the rotation of the magnetic roller 130. Subsequently, the developer layer 194 reaches a region in which the first magnetic field 171 is generated. In this region, the developer layer 194 rises under the influence of the first magnetic field 171, thereby forming the magnetic brush that comes in contact with the developing roller 150.

As shown in FIGS. 2 and 4, the positively charged toner 192 in the developer layer 194 comes in contact with the developing roller 150 and is transferred to the developing roller 150, in response to the developing bias voltage due to a potential difference between the first bias voltage applied to the magnetic roller 130 and the second bias voltage applied to the developing roller 150 through the second voltage application unit 262. In this manner, the toner layer 193 of a predetermined thickness is formed on the surface of the developing roller 150.

Thereafter, an instruction of forming an image (printing) on a sheet of paper T is given to the printer 1 by a user. The user's printing instruction to the printer 1 may either be an instruction of printing an image on a sheet of paper T or an instruction of successively printing images on a plurality of sheets of paper T.

The instruction for printing an image on the sheet of paper T triggers a printing operation of the printer 1 on the sheet of paper T.

The developing device 16 develops an electrostatic latent image formed on the photosensitive drum 2 using the toner layer 193 of the predetermined thickness formed on the surface of the developing roller 150. More specifically, the surface of the developing roller 150 on which the toner layer 193 is formed faces the surface of the photosensitive drum 2 (see FIG. 1) downstream in a rotational direction C. A potential difference between the developing roller 150 and the photosensitive drum 2 develops the electrostatic latent image in a developing region. In other words, with the toner supplied from the toner layer 193 of the developing device 16, a toner image is formed on the electrostatic latent image formed on the surface of the photosensitive drum 2.

As shown in FIG. 1, the toner image developed on the photosensitive drum 2 is transferred to the sheet of paper T by the transfer roller 8. The sheet of paper T with the transferred toner image is conveyed to the fusing unit 9, which causes the toner to be fixed to the sheet of paper T.

Subsequently, the sheet of paper T is fed to the discharging portion 50 via the third paper feed path L3 and discharged from the discharging portion 50 to the discharged paper collection part M1. Printing of the sheet of paper T by the printer 1 is thus completed.

The first bias voltage applied to the magnetic roller 130 via the first voltage application unit 261 is controlled to be lower than a bias voltage of a normal development, at a predetermined timing during a non-developing mode (non-image forming mode). An example of the predetermined timing during the non-developing mode (non-image forming mode) is a timing at which no toner image is formed on the photosensitive drum 2 by the developing device 16. Such a timing includes a time period between completion of printing a sheet of paper T and waiting for a subsequent printing and a case where no subsequent printing instruction is made. As a result, the toner 192 composing the toner layer 193 formed on the developing roller 150 migrates from the developing roller 150 to the magnetic roller 130 due to a mechanical rubbing effect of the magnetic brush formed on the surface of the developing roller 150 under an electrical field weaker than at a time of the normal development.

In other words, the operation of the developing device 16 is switched to a toner layer stripping operation (the magnetic brush strips the toner 192 composing the toner layer 193 formed on the surface of the second rotating sleeve 151 of the developing roller 150).

And then, the developer containing the toner 192 stripped from the surface of the second rotating sleeve 151 of the developing roller 150 falls into the housing 110. The developer containing the toner 192 having fallen into the housing 110 is agitated and electrically charged by the agitation rollers 120*a*, 120*b*.

Upon beginning of a subsequent developing operation, the developer layer (magnetic brush) 194 is formed on the surface of the magnetic roller 130 and the developer layer 194 is controlled to have a predetermined thickness by the layer thickness regulating member 140. Thereafter, as shown in FIG. 4, the toner 192 inside the developer layer 194 that is positively charged according to the developing bias voltage due to a potential difference between the first bias voltage and the second bias voltage migrates toward the developing roller 150. Accordingly, a new toner layer 193 of the predetermined thickness is formed on the surface of the developing roller 150.

The developing device 16 of the printer 1 according to the present embodiment provides, for example, the following effects.

In the present embodiment, the longitudinal end portions 132*e* to 136*e* of the developer supporting side magnetic members 132 to 136 of the magnetic roller 130 are positioned more longitudinally outward than the longitudinal end portion 152*e* of the toner supporting side magnetic member 152 of the developing roller 150. With respect to the opposing magnetic member 132 facing the toner supporting side magnetic member 152 of the developing roller 150 and the downstream magnetic member 133 disposed more downstream in the rotational direction than the opposing magnetic member 132 among the plurality of developer supporting side magnetic members 132 to 136, the magnetic force G1 generated in the vicinity of the both longitudinal end portions is greater than the magnetic force G2 generated on the longitudinally inner side.

In this manner, the portions 194*a* of the magnetic brush 194 at both longitudinal ends of the magnetic roller 130 reach vicinities of both end edges of the second rotating sleeves 151 of the developing roller 150, among the magnetic brush 194 formed on the surface of the first rotating sleeve 131 of the magnetic roller 130. In this manner, the longitudinal length of the developing roller 150 and the longitudinal length of the magnetic brush 194 are substantially the same.

In this manner, the tip of the magnetic brush 194 comes to rub the substantially entire surface of the developing roller 150 in the longitudinal direction. When the toner 192 is stripped from the developing roller 150 toward the magnetic roller 130, a rubbing effect of the magnetic brush 194 allows more infallible stripping of the undeveloped toner 192 remaining on the substantially entire area of the surface of the developing roller 150. Accordingly, it is possible to prevent a reduction in density of an image in a subsequent image formation caused by the degraded residual toner on the surface of the developing roller 150, and degraded image quality and developing defect such as developing ghost caused by long-neglected undeveloped toner.

In addition, the housing 110 according to the present embodiment includes the sealing member 160. The sealing member 160 projects toward the surface 130*a* from a position opposite to the first rotating sleeve 131 located at the longitudinal end portion of the magnetic roller 130 and the surface 130*a* of the flange 137. The sealing member 160 prevents the toner 192 in the space 170 from scattering outside, which is encompassed by the surface 130*a* of the flange 137 and the inner face of the housing 110 (including the first housing portion 111 and the second housing portion 112).

Accordingly, it is possible to securely prevent the carrier 191 and the toner 192 of the magnetic brush portion 194*a* having increased in height due to the magnetic distribution described above from scattering longitudinally outside the magnetic roller 130, among the magnetic brush 194 positioned in the space 170.

In addition, in the present embodiment, the housing 110 includes the concave portion 113. The concave portion 113 is positioned more longitudinally inside than the sealing member 160. The concave portion 113 is configured to recede more in a direction away from the surface of the magnetic roller. 130 than the inner face 112*a* of the housing 110, which is disposed more longitudinally inside than the concave portion 113.

As a result, it is possible to render a filling density of the portion 194*a* of the magnetic brush 194 stored in a gap in the vicinity of the longitudinal end portion of the magnetic roller 130 to be identical or substantially identical to a filling density of the portion 194*b* stored in the gap longitudinally inside the longitudinal end portion of the magnetic roller 130. Accordingly, it is possible to prevent a large amount of the portions 194*a* stored in the gap in the vicinity of the longitudinal end portion of the magnetic roller 130 from being compressed more than the magnetic brush 194 in other regions. Accordingly, it is possible to form the toner layer 193 having uniform thickness and density on the substantially entire surface of the developing roller 150 at a time of a subsequent development operation. As a result, it is also possible to maintain high image quality in a case of successive image formation.

Furthermore, the sealing member 160 according to the present embodiment is composed of an elastic member. Accordingly, it is possible to decrease the load acting on the rotation of the magnetic roller 130, even if the sealing member 160 is in contact with the surface of the magnetic roller 130 without a gap therebetween.

A preferred embodiment of the present disclosure has been described above.

However, the present disclosure is not limited thereto and may be carried out in various modes. For example, the above embodiment has been described for a case in which the toner 192 is positively charged. However, the present disclosure is not limited to this case. The toner 192 may also be negatively charged. A setup, operation and effect in a case of using the toner 192 being negatively charged are the same as those in a case of using the toner 192 being positively charged.

In addition, the magnetic member is not limited to a magnet.

The above embodiment has been described for a case of the image forming apparatus configured for monochromatic printing of a direct transfer type that transfers a toner image to a sheet of paper T by the photosensitive drum 2 and the transfer roller 8. However, the present disclosure is not limited to this case. The present disclosure may be applicable to an image forming apparatus for full-color printing of an indirect transfer type that transfers toner images of a plurality of colors using an intermediate transfer belt.

The image forming apparatus of the present disclosure is not particularly limited, and may include a printer, a color copy machine, a facsimile machine, and a multi-functional device having functions thereof.

The sheet-shaped recording medium is not limited to a sheet of paper T, and may include a film sheet, for example.

The invention claimed is:

1. A developing device comprising:

a housing;

a developer supporting rotator disposed inside the housing, including, a first rotating sleeve configured to support a two-component developer including at least a carrier and toner, the first rotating sleeve extending in a longitudinal direction to form a face on which a magnetic brush is formed by the carrier included in the two-component developer, and a plurality of developer supporting side magnetic members that is disposed inside the first rotating sleeve and extends in the longitudinal direction;

a toner supporting rotator disposed inside the housing including, a second rotating sleeve arranged opposite to the developer supporting rotator and extending in the longitudinal direction to form a face, on which a toner supplied from the developer supporting rotator is supported to form a toner layer through the magnetic brush, and a toner supporting side magnetic member that is disposed inside the second rotating sleeve and extends in the longitudinal direction; and a voltage application unit configured to apply a developing bias voltage between the toner supporting rotator and an image carrier, such that the toner supported by the toner supporting rotator flies to an electrostatic latent image on a surface of the image carrier to cause the electrostatic latent image to be developed into a toner image, wherein a longitudinal end portion of each of the pulurality of developer supporting side magnetic members is positioned more longitudinal outside than a longitudinal end portion of the toner supporting side magnetic member, a magnetic force generated in a vicinity of both longitudinal end portions is greater than a magnetic force generated at a longitudinally inner portion, with respect to an opposing magnetic member facing the toner supporting side magnetic member and a downstream magnetic member disposed more downstream in a rotational direction than the opposing magnetic member, among the plurality of developer supporting side magnetic members, the housing includes a sealing portion that projects from a position of the housing facing a longitudinal end face of the developer supporting rotator toward the longitudinal end face, such that the toner in a space between the longitudinal end face and an inner face of the housing is prevented from scattering outside the space, and the housing includes a concave portion that is positioned more longitudinally inside than the sealing portion and is configured to more recede in a direction away from a surface of the developer supporting rotator than the inner face of the housing that is located more longitudinally inside than the concave portion.

2. The developing device according to claim 1, wherein the sealing portion is positioned opposite to the downstream magnetic member.

3. The developing device according to claim 1, wherein the sealing portion comprises an elastic member.

4. An image forming apparatus comprising:
a developing device;
an image carrier;
a transfer unit; and
a fusing unit,
wherein the developing device comprises:
a housing;
a developer supporting rotator disposed inside the housing, including,
a first rotating sleeve configured to support a two-component developer including at least a carrier and toner, the first rotating sleeve extending in a longitudinal direction to form a face on which a magnetic brush is formed by the carrier included in the two-component developer, and
a plurality of developer supporting side magnetic members that is disposed inside the first rotating sleeve and extends in the longitudinal direction;
a toner supporting rotator disposed inside the housing, including,
a second rotating sleeve arranged opposite to the developer supporting rotator and extending in the longitudinal direction to form a face, on which a toner supplied from the developer supporting rotator is supported to form a toner layer through the magnetic brush, and
a toner supporting side magnetic member that is disposed inside the second rotating sleeve and extends in the longitudinal direction; and
a voltage application unit configured to apply a developing bias voltage between the toner supporting rotator and an image carrier, such that the toner supported by the toner supporting rotator flies to an electrostatic latent image on a surface of the image carrier to cause the electrostatic latent image to be developed into a toner image, wherein
a longitudinal end portion of each of the plurality of developer supporting side magnetic members is positioned more longitudinally outside than a longitudinal end portion of the toner supporting side magnetic member,
a magnetic force generated in a vicinity of both longitudinal end portions is greater than a magnetic force generated at a longitudinally inner portion, with respect to an opposing magnetic member facing the toner supporting side magnetic member and a downstream magnetic member disposed more downstream in a rotational direction than the opposing magnetic member, among the plurality of developer supporting side magnetic members,
the housing includes a sealing portion that projects from a position of the housing facing a longitudinal end face of the developer supporting rotator toward the longitudinal end face, such that the toner in a space between the longitudinal end face and an inner face of the housing is prevented from scattering outside the space, and
the housing includes a concave portion that is positioned more longitudinally inside than the sealing portion and is configured to more recede in a direction away from a surface of the developer supporting rotator than the inner face of the housing that is located more longitudinally inside than the concave portion,
wherein an electrostatic latent image is formed on a surface of the image carrier and a toner image is formed on the electrostatic latent image by the toner supplied from the toner layer of the developing device,
wherein the transfer unit directly or indirectly transfers the toner image formed on the image carrier to a sheet-like recording medium, and
wherein the fusing unit fixes the toner image transferred to the sheet-like recording medium.

* * * * *